United States Patent [19]

Bertsch et al.

[11] Patent Number: 4,492,204

[45] Date of Patent: Jan. 8, 1985

[54] METERING DEVICE FOR AN INTERNAL COMBUSTION ENGINE

[75] Inventors: Richard Bertsch, Asperg; Dieter Günther, Murr; Ulrich Steinbrenner, Stuttgart, all of Fed. Rep. of Germany

[73] Assignee: Robert Bosch GmbH, Stuttgart, Fed. Rep. of Germany

[21] Appl. No.: 411,228

[22] Filed: Aug. 25, 1982

[30] Foreign Application Priority Data

Mar. 4, 1982 [DE] Fed. Rep. of Germany ..... 3207787

[51] Int. Cl.[3] ..... F02D 5/00

[52] U.S. Cl. ..... 123/489; 123/491

[58] Field of Search ..... 123/489, 491, 440

[56] References Cited

U.S. PATENT DOCUMENTS

| | | | |
|---|---|---|---|
| 4,114,570 | 9/1978 | Marchak et al. | 123/491 |
| 4,239,022 | 12/1980 | Drews et al. | 123/491 |
| 4,252,098 | 2/1981 | Tomczak et al. | 123/489 |
| 4,350,131 | 9/1982 | Kiuchi et al. | 123/489 |
| 4,357,922 | 11/1982 | Rosenzopf et al. | 123/489 |

*Primary Examiner*—Andrew M. Dolinar

*Attorney, Agent, or Firm*—Edwin E. Greigg

[57] ABSTRACT

A fuel metering system and method for an internal combustion engine is proposed, having a lambda regulation device and a warm-up enrichment, in which at the onset of regulation the warm-up enrichment is reduced or turned off for the purpose of not having an abnormally high control stroke when transferring to a closed-loop operation and thereby rapidly attaining a stable lambda value.

6 Claims, 1 Drawing Figure

METERING DEVICE FOR AN INTERNAL COMBUSTION ENGINE

BACKGROUND OF THE INVENTION

The present invention is based on a fuel metering device and method for an internal combustion engine with a lambda regulator and a warm-up enrichment, in which at the onset of regulation the warm-up enrichment is reduced or turned off. Such a fuel metering system is already known under the trademark "L-Jetronic". In this system the metering device changes from regulating mode to lambda regulating mode at a time when at least the exhaust sensor has reached its working temperature and therefore is ready. As a rule, warm-up enrichment processes are temperature-dependent in their starting values and are regulated as a function of time.

It has been shown that this known system is not always able to provide a clean exhaust gas under certain operational circumstances because of mixture compositions which are not ideal in these special operational circumstances. This is based on the following physical factors. If the lambda sensor has not been sufficiently heated, it cannot work correctly, except with long idle times. For this reason the result is a mixture not equal to lambda=1 (rich or lean) for relatively long periods of time, which deficiency leads to strong exhaust emissions. This problem becomes especially noticeable during the change from overrun to normal driving conditions.

During overrun the lambda regulator aims for a median lambda value onto which is superimposed the normally multiplicatively-acting warm-up enrichment during the warm-up phase. The lambda regulator goes again into action at the end of the overrun and, because of the relatively slow lambda sensor; it takes a comparatively long time until the lambda regulator with its several switching points goes into action.

OBJECT AND SUMMARY OF THE INVENTION

The fuel metering device and method in accordance with the present invention wherein a warm-up enrichment is reduced when lambda regulation begins assures that, at the beginning of a lambda regulating phase, the range to be regulated does not require too large differences and, therefore, unfavorable exhaust gas values occur only for short periods of time.

The switching off of the warm-up phase is important, for instance when using so-called warm-up performance graphs or additive enrichment in which several warm-up factors are used, depending on load or rpm conditions. This switching-off operation also avoids large incorrect adaptations in the dynamic operation during the idle time of the regulating system.

The invention will be better understood and further objects and advantages thereof will become more apparent from the ensuing detailed description of a preferred embodiment taken in conjunction with the drawing.

BRIEF DESCRIPTION OF THE DRAWING

The only FIGURE in the drawings shows in rough diagram form the electrical part of a fuel metering device.

DESCRIPTION OF THE PREFERRED EMBODIMENT

Figures 1, 1A:
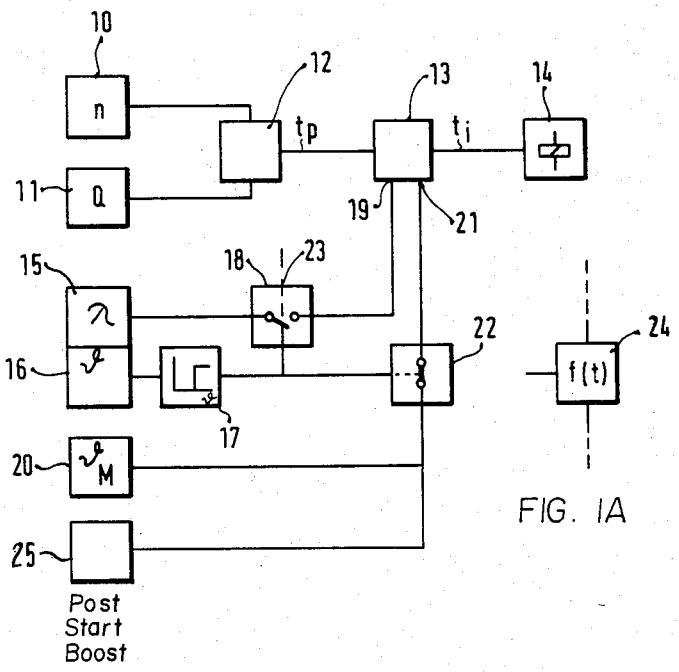

An injection system is used as the basis of the preferred embodiment. It should be noted that the present invention is not dependent on the type of fuel metering system and therefore can also be used with regulated carburetor devices.

Sensors for the rpm and the weight rate of the air flow are designated by 10 and 11. They pass on their output signal to the timing element 12 in which impulses of the duration tp are formed as base injection impulses. A correction stage 13 then follows which leads to at least one electromagnetic injection valve 14.

A lambda sensor is designated by 15. Assigned to it is a sensor-temperature probe 16 to the outlet side of which a threshold value stage 17 is coupled. Dependent on the output signal of the threshold value stage 17, the signal of the lambda sensor 15 is passed on by way of a switch 18 to the correction input 19 of the correction stage 13. In practice it is not really necessary, however, to assign a separate temperature probe 16 to the lambda sensor 15, because in many instances the readiness of the sensor is determined from the signal emitted by it; however, this split-up best shows the nature of the present invention. A sensor 20 for the engine temperature influences, also by way of the input 21, the processing of the signal in the correction stage 13. It is important to dispose between the temperature sensor 20 and the correction input 21 a switch 22 switchably dependent on the readiness of the sensor or the start of the lambda regulation.

The switching arrangement shown in the FIGURE is already known, with the exception of the switch 22. Once the lambda sensor 15 has reached its operating temperature, and with it its readiness, the lambda regulator switches on and the fuel metering system changes over from open-loop control operation to closed-loop control operation. This change-over is accomplished by means of the switched-on contact of the lambda-sensor output signal at the input 19 of the correction stage 13.

The position of the switches 18 and 22 is in relationship to the not-ready-for operation sensor, i.e. when the lambda regulation is switched off and the warm-up enrichment is operating. When changing to lambda regulation, however, the switch 22 is opened and turns off the warm-up enrichment with the consequence that the regulator needs to control a considerably smaller lambda value since the mixture previously prepared was too rich, as a rule, because of the warm-up enrichment.

The same holds true during a transition from the overrun operation with a cut-off of the fuel supply to normal operational mode. During the cut-off phase the integrator normally contained in the lambda regulator is set for a median value (switch 18 is turned off through the control input 23), so that during the transition to normal operation the control stroke does not take on too large values, because the warm-up enrichment does not take place.

Besides turning off the warm-up influence in accordance with the above examples, the warm-up enrichment can simply be reduced to a lower value and/or a normally time-dependent post-start boost 25 can be reduced. As a rule, however, the post-start boost would already be turned off at the time the lambda sensor is operational.

It is furthermore possible to reduce the warm-up enrichment post start boost 25 in accordance with a special time function following the operational readiness of the sensor, instead of turning it completely off. This is symbolically shown by a broken line and a separate box 24.

Which one of the possibilities shown above is used with a specific fuel metering system for an internal combustion engine is dependent on the circumstances and cannot be determined in general. It will be a compromise between sufficient driving comfort and exhaust gas of the greatest possible cleanliness, especially in the transition areas.

Depending on the use it is important that a renewed warm-up enrichment does not take place during the cooling off period of the lambda sensor, e.g. during the low-rpm idling operation and the transition into open-loop control operation caused by it and based on the non-operational status of the sensor. This delay could be realized by means of a simple holding circuit, for instance, for the switch 22.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for controlling fuel supply rate in a fuel metering system for an internal combustion engine having a closed-loop lambda regulating device and means providing a warm-up enrichment, comprising the steps of sensing the temperature of a lambda sensor of said lambda regulating device, switching from an open-loop regulation to closed-loop lambda regulation of fuel supply in response to said sensing step, reducing the amount of warm-up enrichment when said closed-loop regulation begins, switching from said closed-loop regulation to said open-loop regulation in response to sensing of a predetermined temperature range in said sensing step, and preventing the amount of warm-up enrichment from being increased following a return from closed-loop lambda regulation to open-loop regulation.

2. A method for a fuel metering system in accordance with claim 1, further comprising the step of, turning off the warm-up enrichment when said closed-loop begins.

3. A method for a fuel metering system in accordance with claim 1, further comprising the step of, reducing the warm-up enrichment in accordance with a function of time when said closed-loop regulation begins.

4. A method for a fuel metering system having a post-start boost in accordance with claim 1 or 2, further comprising the step of, reducing the post-start boost when said closed-loop regulation begins.

5. A fuel metering control system for an internal combustion engine having a closed-loop lambda regulating means and means providing a warm-up enrichment, comprising a lambda sensor, a temperature sensing means connected to sense the temperature of said lambda sensor, switching means connected to said regulating means responsive to said temperature sensing means for initiating a closed-loop control of fuel metering by said lambda regulating means, reducing the amount of warm-up enrichment provided by said warm-up enrichment means at the onset of closed-loop regulation and terminating said closed-loop control of fuel metering based on the temperature sensed by said temperature sensing means, and means for preventing increasing of said amount of warm-up enrichment following said terminating of said closed-loop control.

6. A fuel metering system according to claim 5, further comprising a correction stage means feeding an electromagnetic injection valve means connected to said switching means.

* * * * *